US012644597B2

(12) United States Patent
Ishii et al.

(10) Patent No.: US 12,644,597 B2
(45) Date of Patent: Jun. 2, 2026

(54) COMBUSTION DEVICE AND BOILER

(71) Applicant: IHI Corporation, Tokyo (JP)

(72) Inventors: Hiroki Ishii, Tokyo (JP); Takahiro Kozaki, Tokyo (JP); Emi Ohno, Tokyo (JP)

(73) Assignee: IHI Corporation, Tokyo (JP)

( * ) Notice: Subject to any disclaimer, the term of this patent is extended or adjusted under 35 U.S.C. 154(b) by 598 days.

(21) Appl. No.: 18/318,851

(22) Filed: May 17, 2023

(65) Prior Publication Data

US 2023/0288061 A1 Sep. 14, 2023

Related U.S. Application Data

(63) Continuation of application No. PCT/JP2021/045795, filed on Dec. 13, 2021.

(30) Foreign Application Priority Data

Feb. 19, 2021 (JP) ..... 2021-025116

(51) Int. Cl.
*F23D 17/00* (2006.01)
*F23D 1/00* (2006.01)
*F23D 11/38* (2006.01)

(52) U.S. Cl.
CPC ..... *F23D 17/007* (2013.01); *F23D 1/00* (2013.01); *F23D 11/38* (2013.01); *F23D 2204/30* (2013.01); *F23D 2208/10* (2013.01)

(58) Field of Classification Search
CPC ..... F23D 17/007; F23D 1/00; F23D 11/38; F23D 2204/30; F23D 2208/10; F23D 17/00; F23D 17/005; F23C 2201/101; F23C 1/10; F23C 1/12; F23C 5/32; F23J 7/00; F23L 9/02; F23N 1/022; F23N 5/00; F23N 1/02
See application file for complete search history.

(56) References Cited

U.S. PATENT DOCUMENTS

| | | | | |
|---|---|---|---|---|
| 2012/0177553 | A1* | 7/2012 | Lindemann | F23J 15/003 423/239.1 |
| 2014/0050644 | A1* | 2/2014 | Colannino | F23J 15/02 422/111 |
| 2020/0018231 | A1* | 1/2020 | Ito | F23R 3/346 |
| 2020/0032712 | A1* | 1/2020 | Ito | F02C 3/22 |
| 2021/0140634 | A1* | 5/2021 | Zhang | F23C 1/12 |
| 2021/0364163 | A1 | 11/2021 | Kiyama et al. | |

FOREIGN PATENT DOCUMENTS

| | | | |
|---|---|---|---|
| JP | 58-18017 | A | 2/1983 |
| JP | 58-193011 | A | 11/1983 |
| JP | WO 96/41948 | A1 | 12/1996 |
| JP | 2018-123755 | A | 8/2018 |

(Continued)

OTHER PUBLICATIONS

International Search Report issued Feb. 8, 2022 in PCT/JP2021/045795, filed on Dec. 13, 2021, 2 pages.

*Primary Examiner* — David J Laux
(74) *Attorney, Agent, or Firm* — Oblon, McClelland, Maier & Neustadt, L.L.P.

(57) ABSTRACT

Provided is a combustion device, including: a burner including an ammonia injection nozzle having an injection port that faces an inner space of a furnace; and an adjustment structure configured to adjust an opening area of the injection port.

9 Claims, 6 Drawing Sheets

(56) References Cited

FOREIGN PATENT DOCUMENTS

| | | | |
|---|---|---|---|
| JP | 2018-138863 | A | 9/2018 |
| JP | 2019-15179 | A | 1/2019 |
| JP | 2019-86188 | A | 6/2019 |
| JP | 2019-86189 | A | 6/2019 |
| JP | 2019-86191 | A | 6/2019 |
| JP | 2019-203631 | A | 11/2019 |
| KR | 10-2021-0011431 | A | 2/2021 |
| WO | WO 2014/027611 | A1 | 2/2014 |

* cited by examiner

COMBUSTION DEVICE AND BOILER

CROSS REFERENCE TO RELATED APPLICATIONS

This application is a continuation application of International Application No. PCT/JP2021/045795, filed on Dec. 13, 2021, which claims priority to Japanese Patent Application No. 2021-025116, filed on Feb. 19, 2021, the entire contents of which are incorporated by reference herein.

BACKGROUND ART

Technical Field

The present disclosure relates to a combustion device and a boiler. This application claims the benefit of priority to Japanese Patent Application No. 2021-025116 filed on Feb. 19, 2021, and contents thereof are incorporated herein.

Related Art

As a burner provided to a furnace of a boiler or the like, there is known a burner including an ammonia injection nozzle that injects ammonia as fuel. Through use of ammonia as fuel, the emission amount of carbon dioxide is reduced. For example, in Patent Literature 1, there is a disclosure of a burner that performs co-combustion of pulverized coal and ammonia as fuel.

CITATION LIST

Patent Literature

Patent Literature 1: 2019-086189 A

SUMMARY

Technical Problem

Incidentally, in a burner including an ammonia injection nozzle, when ammonia injected from the ammonia injection nozzle reaches a reduction region of flame (i.e., a region in which nitrogen oxide (hereinafter sometimes referred to as "NOx") to be reduced is reduced), NOx is reduced. Here, depending on operation conditions, there is a risk in that the injected ammonia may not be sufficiently supplied to the reduction region of flame, and NOx in a combustion gas to be exhausted may be increased.

Accordingly, there has been a demand for a new proposal to decrease NOx.

The present disclosure has an object to provide a combustion device and a boiler capable of decreasing nitrogen oxide (NOx).

Solution to Problem

In order to solve the above-mentioned problem, according to the present disclosure, there is provided a combustion device, including: a burner including an ammonia injection nozzle having an injection port that faces an inner space of a furnace; and an adjustment structure configured to adjust an opening area of the injection port.

The combustion device may further include a control device configured to control operation of the adjustment structure so that the opening area of the injection port becomes smaller as a flow rate of ammonia in the ammonia injection nozzle becomes lower.

The burner may include a pulverized coal injection nozzle having an injection port that faces the inner space of the furnace, and the combustion device may include a control device configured to control operation of the adjustment structure based on a flow rate of pulverized coal in the pulverized coal injection nozzle.

The combustion device may further include: an air supply portion having an injection port that faces the inner space of the furnace; and a control device configured to control operation of the adjustment structure based on a flow rate of air in the air supply portion.

The combustion device may further include a control device configured to control operation of the adjustment structure based on a temperature in the inner space of the furnace.

In order to solve the above-mentioned problem, according to the present disclosure, there is provided a boiler including the above-mentioned combustion device.

Effects of Disclosure

According to the present disclosure, it is possible to decrease nitrogen oxide (NOx).

DESCRIPTION OF EMBODIMENT

Figure 1:
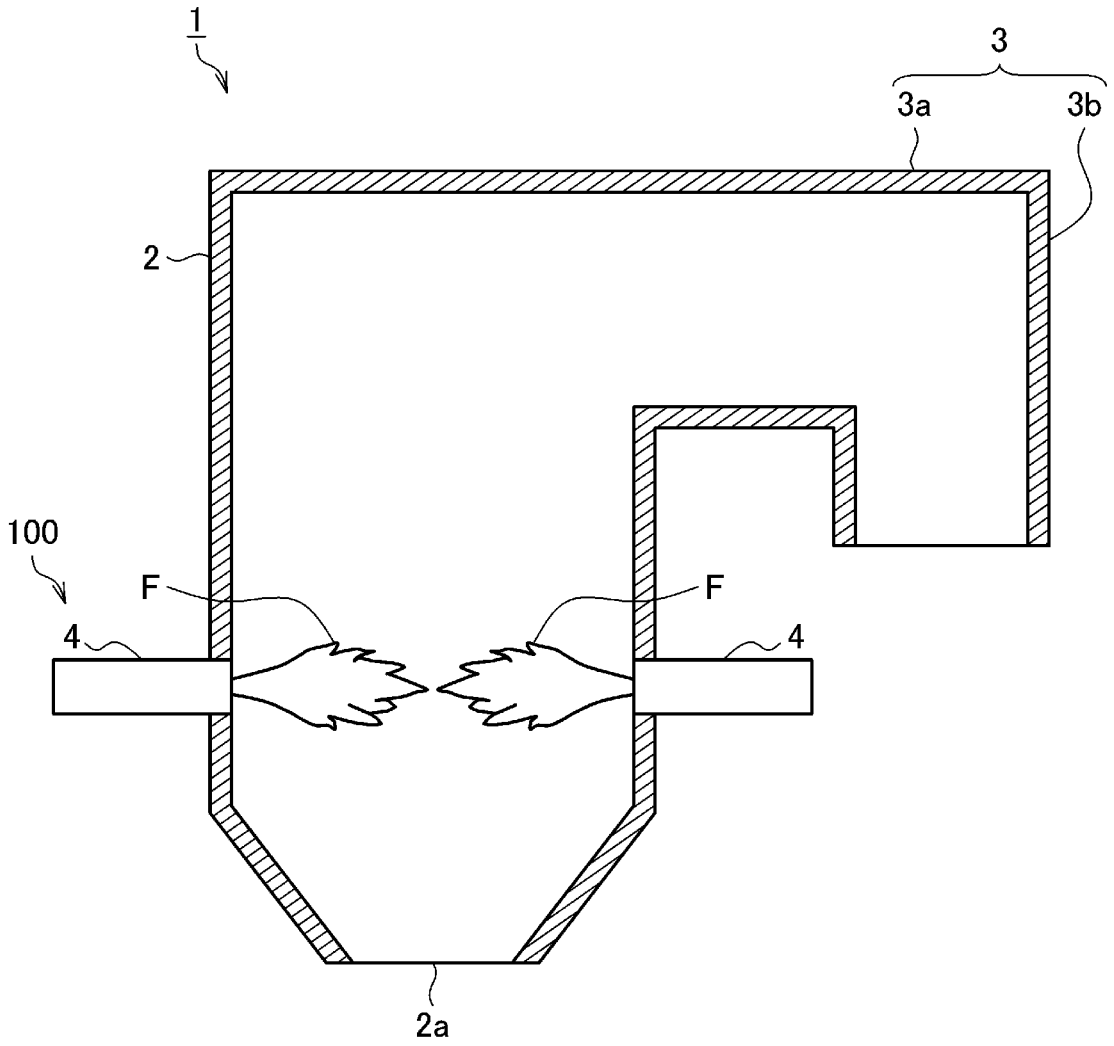
FIG. 1 is a schematic view for illustrating a boiler according to an embodiment.

Now, with reference to the attached drawings, an embodiment of the present disclosure is described. The dimensions, materials, and other specific numerical values represented in the embodiment are merely examples used for facilitating the understanding of the disclosure, and do not limit the present disclosure otherwise particularly noted. Elements having substantially the same functions and configurations herein and in the drawings are denoted by the same reference symbols to omit redundant description thereof. Further, illustration of elements with no direct relationship to the present disclosure is omitted.

FIG. 1 is a schematic view for illustrating a boiler 1 according to this embodiment. As illustrated in FIG. 1, the boiler 1 includes a furnace 2, a flue gas duct 3, and a burner 4.

The furnace 2 is a furnace that generates combustion heat by burning fuel. In the following, an example in which ammonia and pulverized coal are used as fuel in the furnace 2 is mainly described. When ammonia and pulverized coal are used as fuel, the emission amount of carbon dioxide is reduced. However, as described later, the fuel to be used in the furnace 2 is not limited to this example.

The furnace 2 has a tubular shape (e.g., a rectangular tubular shape) extending in a vertical direction. In the furnace 2, a high-temperature combustion gas is generated when fuel is burnt. A discharge port 2*a* for discharging an ash content generated by combustion of fuel to the outside is formed in a bottom portion of the furnace 2.

The flue gas duct 3 is a path for guiding the combustion gas generated in the furnace 2 to the outside as an exhaust gas. The flue gas duct 3 is connected to an upper portion of the furnace 2. The flue gas duct 3 includes a horizontal flue gas duct 3*a* and a rear flue gas duct 3*b*. The horizontal flue gas duct 3*a* extends in a horizontal direction from the upper portion of the furnace 2. The rear flue gas duct 3*b* extends downward from an end portion of the horizontal flue gas duct 3*a*.

The boiler 1 includes a superheater (not shown) installed in, for example, the upper portion of the furnace 2. In the superheater, heat exchange is performed between the combustion heat generated in the furnace 2 and water. As a result, water steam is generated. In addition, the boiler 1 may also include various types of equipment (e.g., a repeater, an economizer, or an air preheater) not shown in FIG. 1.

The burner 4 is provided on a wall portion in a lower portion of the furnace 2. In the furnace 2, a plurality of burners 4 are provided at intervals in a circumferential direction of the furnace 2. Although not shown in FIG. 1, the plurality of burners 4 are provided at intervals also in an extending direction (up-and-down direction) of the furnace 2. The burner 4 injects ammonia and pulverized coal into the furnace 2 as fuel. Flame F is formed in the furnace 2 when the fuel injected from the burner 4 is burnt. In the furnace 2, an ignition device (not shown) that ignites the fuel injected from the burner 4 is provided.

Figure 2:
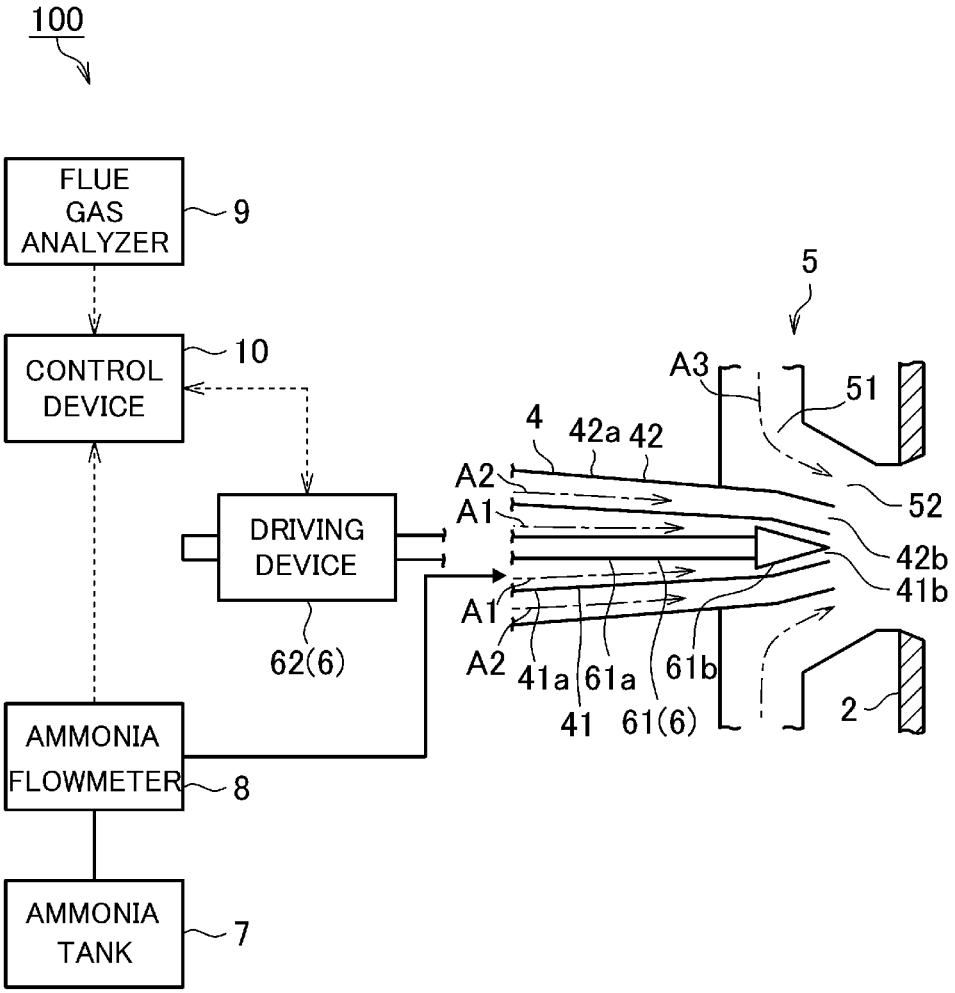
FIG. 2 is a schematic diagram for illustrating a combustion device according to the embodiment.

FIG. 2 is a schematic diagram for illustrating a combustion device 100 according to this embodiment. As illustrated in FIG. 2, the combustion device 100 includes the burner 4, an air supply portion 5, an adjustment structure 6, an ammonia tank 7, an ammonia flowmeter 8, a flue gas analyzer 9, and a control device 10.

The burner 4 is mounted to the wall portion of the furnace 2 outside the furnace 2. The burner 4 includes an ammonia injection nozzle 41 and a pulverized coal injection nozzle 42. The ammonia injection nozzle 41 is a nozzle for injecting ammonia. The pulverized coal injection nozzle 42 is a nozzle for injecting pulverized coal.

The ammonia injection nozzle 41 and the pulverized coal injection nozzle 42 each have a cylindrical shape. The pulverized coal injection nozzle 42 is arranged so as to surround the ammonia injection nozzle 41 coaxially with the ammonia injection nozzle 41. A double cylinder structure is formed by the ammonia injection nozzle 41 and the pulverized coal injection nozzle 42. Center axes of the ammonia injection nozzle 41 and the pulverized coal injection nozzle 42 intersect with (specifically are substantially orthogonal to) the wall portion of the furnace 2.

A radial direction of the burner 4, an axial direction of the burner 4, and a circumferential direction of the burner 4 are hereinafter sometimes simply referred to as "radial direction", "axial direction", and "circumferential direction". The furnace 2 side (right side in FIG. 2) of the burner 4 is referred to as "distal end side", and the side (left side in FIG. 2) of the burner 4 opposite to the furnace 2 side is referred to as "rear end side".

The ammonia injection nozzle 41 includes a main body 41*a* and an injection port 41*b*. The main body 41*a* has a cylindrical shape. A center axis of the main body 41*a* intersects with (specifically is substantially orthogonal to) the wall portion of the furnace 2. The main body 41*a* has a shape that is tapered toward the distal end side. In a rear portion (i.e., a portion on the rear end side) of the main body 41*a*, a supply port (not shown) is formed. The supply port of the ammonia injection nozzle 41 is connected to the ammonia tank 7. The injection port 41*b* that is an opening is formed at a distal end of the main body 41*a*. The injection port 41*b* faces an inner space of the furnace 2. That is, the injection port 41*b* is directed to the inner space of the furnace 2.

Ammonia is supplied from the ammonia tank 7 into the main body 41*a* through the supply port (not shown). As indicated by the arrows A1, the ammonia supplied into the main body 41*a* flows in a space between an inner peripheral portion of the main body 41*a* and a valve body 61 of the adjustment structure 6 described later. The ammonia having passed through the main body 41*a* is injected from the injection port 41*b* toward the inner space of the furnace 2. In this manner, the ammonia injection nozzle 41 is provided so as to be directed to the inner space of the furnace 2.

The pulverized coal injection nozzle 42 includes a main body 42*a* and an injection port 42*b*. The main body 42*a* has a cylindrical shape. The main body 42*a* is arranged so as to surround the main body 41*a* coaxially with the main body 41*a* of the ammonia injection nozzle 41. The main body 42*a* has a shape that is tapered toward the distal end side. A supply port (not shown) is formed in a rear portion (i.e., a portion on the rear end side) of the main body 42*a*.

The supply port of the pulverized coal injection nozzle 42 is connected to a pulverized coal supply source (not shown). The injection port 42*b* that is an opening is formed at a distal end of the main body 42*a*. An axial position of the distal end of the main body 42*a* substantially matches an axial position of the distal end of the main body 41*a* of the ammonia injection nozzle 41. The injection port 42*b* is an annular opening between the distal end of the main body 42*a* and the distal end of the main body 41*a* of the ammonia injection nozzle 41. The injection port 42*b* faces the inner space of the furnace 2. That is, the injection port 42*b* is directed to the inner space of the furnace 2.

Pulverized coal is supplied from the pulverized coal supply source into the main body 42*a* through the supply port (not shown) together with air for conveying pulverized coal. As indicated by the arrows A2, the pulverized coal supplied into the main body 42*a* flows together with air in a space between an inner peripheral portion of the main body 42*a* and an outer peripheral portion of the main body 41*a* of the ammonia injection nozzle 41. The pulverized coal having passed through the main body 42*a* is injected from the injection port 42*b* toward the inner space of the furnace 2. In this manner, the pulverized coal injection nozzle 42 is so as to be directed to the inner space of the furnace 2.

The air supply portion 5 supplies air for combustion from a radially outer side to the flame (see the flame F in FIG. 1) formed by the burner 4. The air supply portion 5 is arranged so as to cover an area between a distal end portion of the burner 4 and the furnace 2. A flow path 51 that allows the air to flow therethrough is formed in the air supply portion 5. The flow path 51 is formed into a cylindrical shape coaxially with the burner 4. The flow path 51 is connected to an air supply source (not shown). An injection port 52 is formed in an end portion of the flow path 51 on the furnace 2 side.

As indicated by the arrows A3, the air supplied from the air supply source to the air supply portion 5 passes through the flow path 51 and is injected from the injection port 52 toward the inner space of the furnace 2. The injection port 52 faces the inner space of the furnace 2. That is, the injection port 52 is directed to the inner space of the furnace 2. In this manner, the air supply portion 5 is provided so as to be directed to the inner space of the furnace 2. The air injected from the injection port 52 of the air supply portion 5 advances toward the inner space of the furnace 2 while revolving in the circumferential direction.

The adjustment structure 6 adjusts an opening area of the injection port 41*b* of the ammonia injection nozzle 41. In the example in FIG. 2, the adjustment structure 6 includes the valve body 61 and a driving device 62. However, as described later, the configuration of the adjustment structure 6 is not limited to this example.

The valve body 61 includes a shaft portion 61*a* and a cone portion 61*b*. The valve body 61 may be solid or hollow. The shaft portion 61*a* extends on the center axis of the burner 4. The shaft portion 61*a* is arranged so as to be surrounded by the main body 41*a* coaxially with the main body 41*a* of the ammonia injection nozzle 41. The shaft portion 61*a* protrudes backward through the rear portion of the main body 41*a* of the ammonia injection nozzle 41. The cone portion 61*b* is mounted to a distal end of the shaft portion 61*a*. The cone portion 61*b* has a shape (conical shape in the example in FIG. 2) that is tapered toward the distal end side. The cone portion 61*b* is located in the vicinity of the distal end of the main body 41*a* of the ammonia injection nozzle 41 in the axial direction.

The driving device 62 moves the valve body 61 in the axial direction. For example, the driving device 62 includes a mechanism that guides the movement of the shaft portion 61*a* in the axial direction and a device that generates power (e.g., a motor). Then, the driving device 62 can move the valve body 61 in the axial direction by transmitting the power to a rear portion of the shaft portion 61*a*.

When an axial position of a distal end of the cone portion 61*b* is located on a rear side (i.e., on an opposite side to the furnace 2 side) from the axial position of the distal end of the main body 41*a* of the ammonia injection nozzle 41, the injection port 41*b* of the ammonia injection nozzle 41 is a circular opening defined by an inner peripheral portion of the distal end of the main body 41*a*. Accordingly, the opening area of the injection port 41*b* of the ammonia injection nozzle 41 is the area of the circular opening defined by the inner peripheral portion of the distal end of the main body 41*a*. In this case, the opening area of the injection port 41*b* becomes maximum.

Meanwhile, when the axial position of the distal end of the cone portion 61*b* is located on the furnace 2 side from the axial position of the distal end of the main body 41*a* of the ammonia injection nozzle 41, the injection port 41*b* of the ammonia injection nozzle 41 is an annular opening defined between the inner peripheral portion of the distal end of the main body 41*a* and an outer peripheral portion of the cone portion 61*b*. Accordingly, the opening area of the injection port 41*b* of the ammonia injection nozzle 41 is the area of the annular opening defined between the inner peripheral portion of the distal end of the main body 41*a* and the outer peripheral portion of the cone portion 61*b*. In this case, the opening area of the injection port 41*b* is smaller as compared to the case in which the injection port 41*b* is a circular opening.

In the case in which the axial position of the distal end of the cone portion 61*b* is located on the furnace 2 side from the axial position of the distal end of the main body 41*a* of the ammonia injection nozzle 41, when the axial position of the valve body 61 is changed, an outer diameter of the valve body 61 at the axial position of the distal end of the main body 41 is changed. As a result, the opening area of the injection port 41*b* having an annular shape between the distal end of the main body 41*a* and the cone portion 61*b* is changed. As the axial position of the valve body 61 becomes closer to the furnace 2, the outer diameter of the valve body 61 at the axial position of the distal end of the main body 41*a* becomes larger, and hence the opening area of the injection port 41*b* becomes smaller.

As described above, the adjustment structure 6 can adjust the opening area of the injection port 41*b* of the ammonia injection nozzle 41 by moving the valve body 61 in the axial direction with the driving device 62. In this embodiment, a decrease in nitrogen oxide (NOx) is achieved by providing the adjustment structure 6 in the combustion device 100. The action and effect of decreasing NOx by the adjustment structure 6 are described later.

The ammonia flowmeter 8 measures a flow rate of the ammonia supplied from the ammonia tank 7 to the ammonia injection nozzle 41. The measurement results given by the ammonia flowmeter 8 are output to the control device 10.

The flue gas analyzer 9 analyzes components of the exhaust gas that is the combustion gas discharged from the furnace 2. The analysis results given by the flue gas analyzer 9 are output to the control device 10.

The control device 10 includes a central processing unit (CPU), a ROM storing programs and the like, a RAM serving as a work area, and the like and controls the entire combustion device 100. In particular, the control device 10 controls the operation of the adjustment structure 6. For example, the current axial position of the valve body 61 is output from the adjustment structure 6 to the control device 10. Then, the control device 10 can control the operation of the adjustment structure 6 based on the output results given by the adjustment structure 6 so that the axial position of the valve body 61 is brought to a target position.

Figure 3:
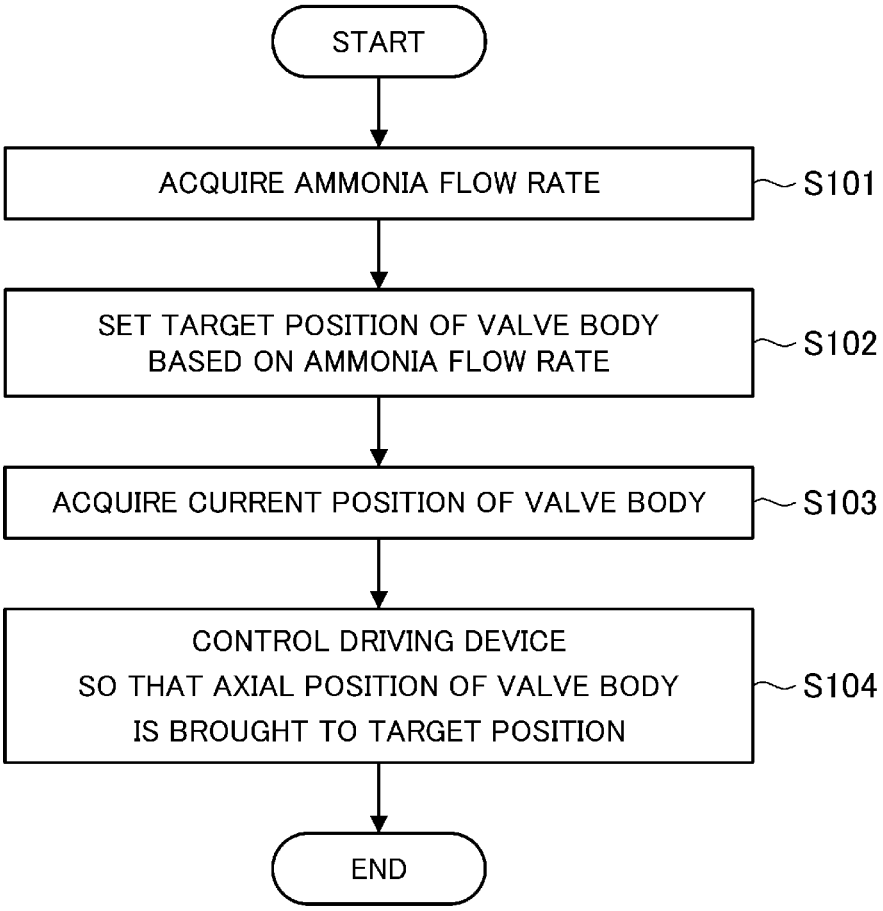
FIG. 3 is a flowchart for illustrating an example of a flow of processing performed by a control device according the embodiment.

FIG. 3 is a flowchart for illustrating an example of a flow of processing performed by the control device 10 according to this embodiment. The processing flow illustrated in FIG. 3 is performed repeatedly, for example, at set time intervals.

When the processing flow illustrated in FIG. 3 is started, in Step S101, the control device 10 acquires the flow rate of ammonia (hereinafter sometimes referred to as "ammonia flow rate") in the ammonia injection nozzle 41. For example, the control device 10 acquires the measurement results given by the ammonia flowmeter 8 as the flow rate of ammonia in the ammonia injection nozzle 41.

In Step S102 subsequent to Step S101, the control device 10 sets the target position (specifically, the axial position to be a target) of the valve body 61 based on the ammonia flow rate. Here, the control device 10 sets the position closer to the inner space of the furnace 2 as the target position of the valve body 61 as the ammonia flow rate becomes lower.

In Step S103 subsequent to Step S102, the control device 10 acquires the current position (specifically, the current axial position) of the valve body 61. For example, the control device 10 acquires the current position of the valve body 61 from the adjustment structure 6.

In Step S104 subsequent to Step S103, the control device 10 controls the driving device 62 so that the axial position of the valve body 61 is brought to the target position, and the processing flow illustrated in FIG. 3 is ended. In Step S104, for example, when there is a difference between the current position and the target position of the valve body 61, the control device 10 moves the valve body 61 so that the difference is eliminated.

As described above, in the processing flow illustrated in FIG. 3, the control device 10 controls the operation of the driving device 62 so that the valve body 61 is moved toward the inner side of the furnace 2 as the ammonia flow rate becomes lower. With this configuration, the control device 10 can control the operation of the adjustment structure 6 so that the opening area of the injection port 41*b* of the ammonia injection nozzle 41 becomes smaller as the ammonia flow rate becomes lower.

Figure 4:
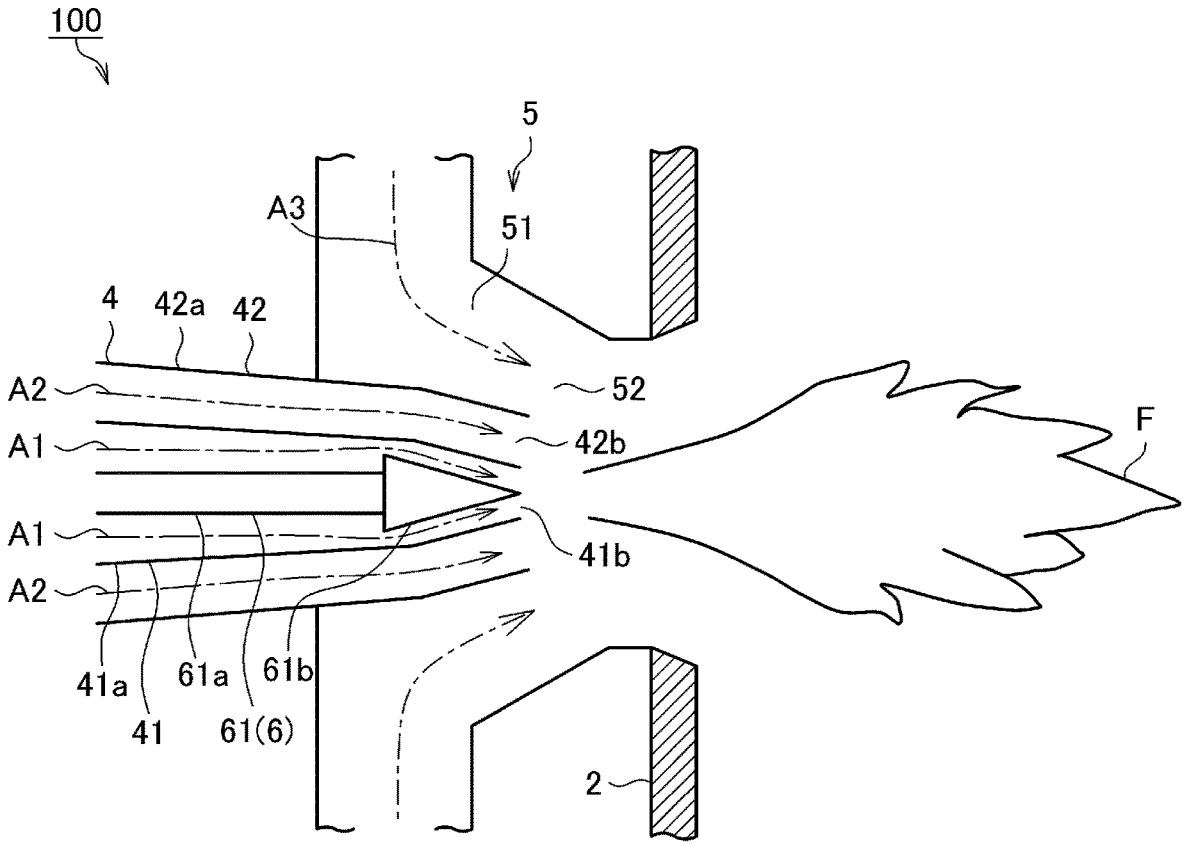
FIG. 4 is a schematic view for illustrating flame formed by a burner according to the embodiment.

FIG. 4 is a schematic view for illustrating the flame F formed by the burner 4 according to this embodiment. In the burner 4, the flame F is formed in front of the burner 4 when ammonia is injected from the ammonia injection nozzle 41, pulverized coal is injected from the pulverized coal injection nozzle 42, and air for combustion is supplied from the air supply portion 5. The flame F thus formed has a reduction region that is a region in which NOx is reduced. The reduction region is present, for example, on a radially outer side in the region in which the flame F is formed.

When the ammonia injected from the ammonia injection nozzle 41 reaches the reduction region of the flame F, NOx is reduced. Here, when a power generation amount in power generation using the boiler 1 is changed, a co-combustion ratio of the ammonia (ratio of the ammonia in the fuel injected from the burner 4) may be changed. In this case, the flow rate of ammonia (i.e., the ammonia flow rate) in the ammonia injection nozzle 41 is changed by changing the flow rate of the ammonia supplied to the ammonia injection nozzle 41.

In the related art, when the flow rate of ammonia (i.e., the ammonia flow rate) in the ammonia injection nozzle 41 is lowered, an injection speed of the ammonia injected from the ammonia injection nozzle 41 is lowered. As a result, the ammonia injected from the ammonia injection nozzle 41 is not sufficiently supplied to the reduction region of the flame F, and there has been a risk in that NOx in the combustion gas to be exhausted may be increased.

Figure 5:
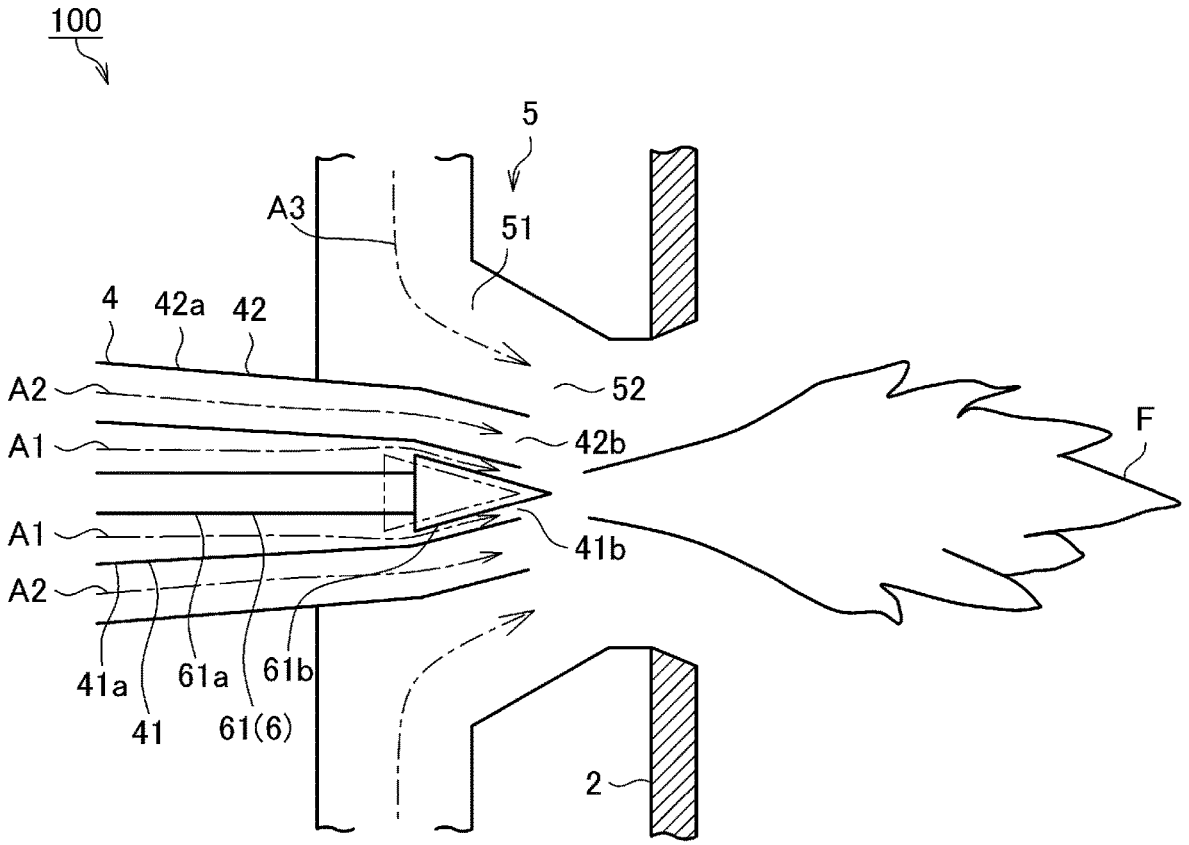
FIG. 5 is a schematic view for illustrating a state in which an opening area of an injection port of an ammonia injection nozzle according to the embodiment is smaller as compared to the example in FIG. 4.

In view of the foregoing, in this embodiment, as described above, the operation of the adjustment structure 6 is controlled so that the opening area of the injection port 41*b* becomes smaller as the ammonia flow rate becomes lower. FIG. 5 is a schematic view for illustrating a state in which the opening area of the injection port 41*b* of the ammonia injection nozzle 41 according to this embodiment is smaller as compared to the example in FIG. 4.

In the example in FIG. 5, the ammonia flow rate is lower as compared to the example in FIG. 4. Because of this, the valve body 61 is further moved toward the inner side of the furnace 2 as compared to the example in FIG. 4. With this configuration, the injection port 41*b* is narrowed by the cone portion 61*b*, and the opening area of the injection port 41*b* becomes smaller. As a result, the lowering of the injection speed of ammonia caused by the lowering of the ammonia flow rate is suppressed. Because of this, the injection speed of ammonia can be maintained at the same level as that of the example in FIG. 4. Accordingly, when ammonia is sufficiently supplied to the reduction region of the flame F in the example in FIG. 4, ammonia is sufficiently supplied to the reduction region of the flame F also in the example in FIG. 5. In this manner, the decrease in NOx is suitably achieved.

As described above, the combustion device 100 according to this embodiment includes the adjustment structure 6 that adjusts the opening area of the injection port 41*b* of the ammonia injection nozzle 41. With this configuration, the lowering of the injection speed of ammonia caused by a change in operation condition is suppressed, and hence NOx is decreased. In particular, when the operation of the adjustment structure 6 is controlled based on the ammonia flow rate, the decrease in NOx is suitably achieved.

Here, from the viewpoint of further effectively decreasing NOx, it is preferred that a relationship between the ammonia flow rate and the opening area of the injection port 41*b* be optimized through use of the measurement value of NOx in the exhaust gas discharged from the furnace 2. The measurement value of NOx in the exhaust gas discharged from the furnace 2 is obtained, for example, based on the analysis results given by the flue gas analyzer 9. For example, the measurement values of NOx in the exhaust gas given when the opening area of the injection port 41*b* is changed variously with respect to the same ammonia flow rate are accumulated as data. Next, a map defining the relationship between the ammonia flow rate and the opening area of the injection port 41*b* is created through use of the accumulated data so that NOx in the exhaust gas is effectively decreased. Then, the control device 10 is caused to control the adjustment structure 6 so that the relationship between the ammonia flow rate and the opening area of the injection port 41*b* becomes the relationship indicated by the created map. Thus, NOx is further effectively decreased.

In addition, from the viewpoint of further effectively decreasing NOx, the control device 10 may control the operation of the adjustment structure 6 based on various parameters other than the ammonia flow rate. For example, the control device 10 may control the operation of the adjustment structure 6 based on other parameters described below in addition to the ammonia flow rate. In addition, for example, the control device 10 may control the operation of the adjustment structure 6 based on other parameters described below instead of the ammonia flow rate. Examples of various parameters that may be used for controlling the adjustment structure 6 are described below.

The control device 10 may control the operation of the adjustment structure 6 based on a flow rate of pulverized coal (hereinafter sometimes referred to as "pulverized coal flow rate") in the pulverized coal injection nozzle 42. For example, the control device 10 controls the operation of the adjustment structure 6 so that the opening area of the injection port 41*b* becomes smaller as the pulverized coal flow rate becomes higher. As the pulverized coal flow rate becomes higher, a flow rate of air for conveying pulverized coal becomes higher. Because of this, the ammonia injected from the ammonia injection nozzle 41 is dragged by the air injected from the pulverized coal injection nozzle 42 and does not easily spread to the entire region of the frame F. Accordingly, when the opening area of the injection port 41*b* is set smaller, the injection speed of ammonia is raised, and ammonia can be easily supplied sufficiently to the reduction region of the flame F.

The control device 10 may control the operation of the adjustment structure 6 based on a flow rate of air (hereinafter sometimes referred to as "supplied air flow rate") in the air supply portion 5. For example, the control device 10 controls the operation of the adjustment structure 6 so that the opening area of the injection port 41*b* becomes smaller as the supplied air flow rate becomes higher. As the supplied air flow rate becomes higher, the ammonia injected from the ammonia injection nozzle 41 is dragged by the air injected from the air supply portion 5 and does not easily spread to the entire region of the frame F. Accordingly, when the opening area of the injection port 41*b* is set smaller, the injection speed of ammonia is raised, and ammonia can be easily supplied sufficiently to the reduction region of the flame F.

The control device 10 may control the operation of the adjustment structure 6 based on a temperature in the inner space of the furnace 2 (hereinafter sometimes referred to as "furnace temperature"). For example, the control device 10 controls the operation of the adjustment structure 6 so that the opening area of the injection port 41*b* becomes smaller as the furnace temperature becomes higher. As the furnace temperature becomes higher, the air injected from the pulverized coal injection nozzle 42 and the air supply portion 5 expands, and the flow rate of the air becomes higher. Because of this, the ammonia injected from the ammonia injection nozzle 41 is dragged by the air injected from the pulverized coal injection nozzle 42 and the air supply portion 5 and does not easily spread to the entire region of the flame F. Accordingly, when the opening area of the injection port 41*b* is set smaller, the injection speed of ammonia is raised, and ammonia can be easily supplied sufficiently to the reduction region of the flame F.

In the foregoing, although details of the ignition device of the furnace 2 are not mentioned, an oil burner, for example, is used as the ignition device of the furnace 2. The oil burner performs ignition by injecting oil into the inner space of the furnace 2. The oil burner is provided to at least one of the burners 4 (specifically, the lowest burner 4 of the plurality of burners 4 arranged in the up-and-down direction). The oil burner extends on the center axis of the burner 4. The burner 4 described above with reference to FIG. 2 and the like is a burner without an oil burner. However, the adjustment structure 6 may be provided to the burner to which the oil burner is provided. In this case, for example, the oil burner may be provided so as to penetrate through the valve body 61 in the axial direction. Alternatively, a mechanism in which the outer shape of the oil burner is set to the same shape as that of the valve body 61 and the oil burner is provided so as to be movable in the axial direction instead of the valve body 61 may be used as the adjustment structure 6.

Figure 6:
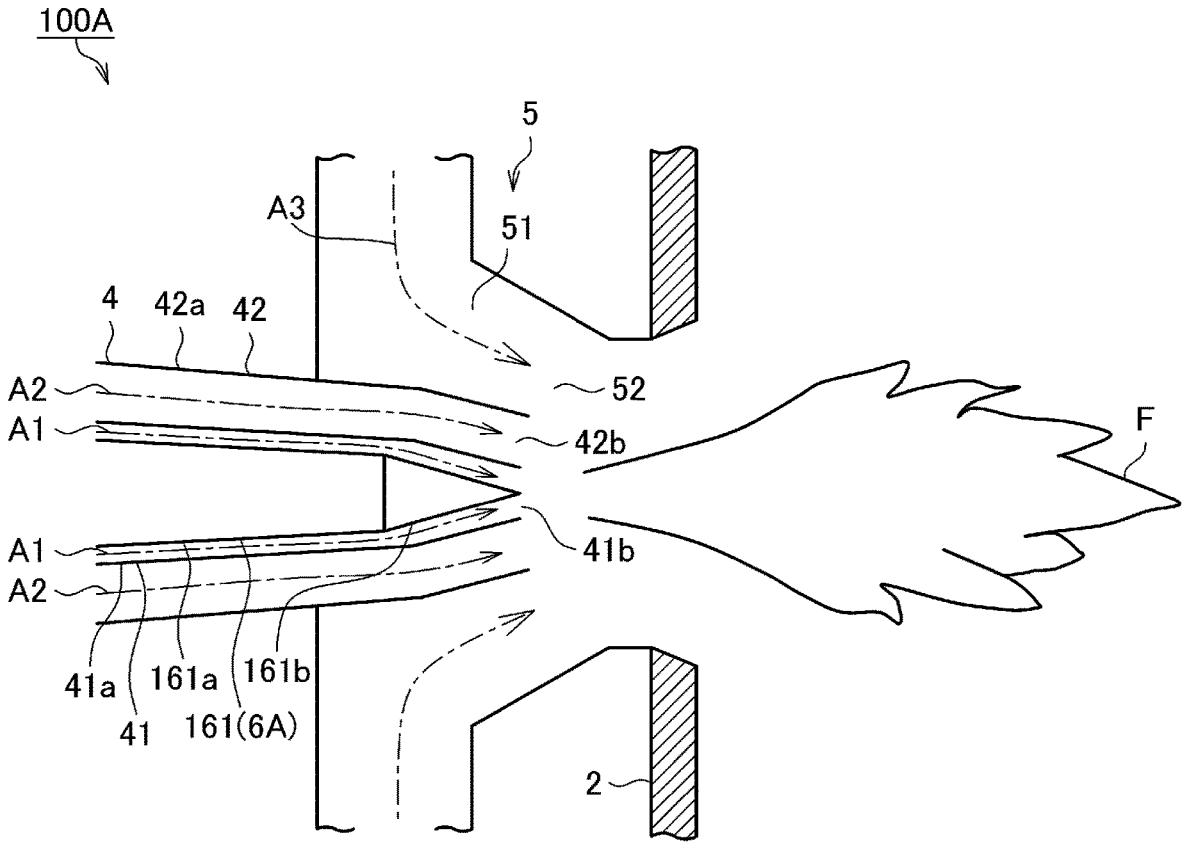
FIG. 6 is a schematic view for illustrating a combustion device according to a modification example.

FIG. 6 is a schematic view for illustrating a combustion device 100A according to a modification example. As illustrated in FIG. 6, in the combustion device 100A, a configuration of a valve body of an adjustment structure is different from that in the combustion device 100 described above. An adjustment structure 6A of the combustion device 100A includes a valve body 161 different from the valve body 61 of the adjustment structure 6 described above.

The adjustment structure 6A includes the driving device 62 in the same manner as in the adjustment structure 6 described above. The adjustment structure 6A is the same as the adjustment structure 6 described above in that the opening area of the injection port 41*b* of the ammonia injection nozzle 41 is adjusted when the valve body 161 is moved in the axial direction by the driving device 62.

The valve body 161 of the adjustment structure 6A includes a shaft portion 161*a* and a cone portion 161*b*. The shaft portion 161*a* extends on the center axis of the burner 4 in the same manner as in the shaft portion 61*a* of the valve body 61 described above. The cone portion 161*b* is mounted to a distal end of the shaft portion 161*a*. The cone portion 161*b* has a shape (conical shape in the example in FIG. 6) that is tapered toward the distal end side in the same manner as in the cone portion 61*b* of the valve body 61 described above.

Here, an outer peripheral portion of the valve body 161 according to the modification example extends along the inner peripheral portion of the main body 41*a* of the ammonia injection nozzle 41. That is, a radial clearance formed between the inner peripheral portion of the main body 41*a* and the outer peripheral portion of the valve body 161 is substantially constant irrespective of the axial position. Specifically, the shaft portion 161*a* has a shape that is tapered toward the distal end side. An outer diameter of the distal end of the shaft portion 161*a* substantially matches an outer diameter of a rear end of the cone portion 161*b*. That is, no step is formed between the shaft portion 161*a* and the cone portion 161*b*.

As described above, when the clearance between the main body 41*a* and the valve body 161 is substantially constant irrespective of the axial position, the flow of the ammonia in the main body 41*a* of the ammonia injection nozzle 41 can be smoothed. In addition, the smoothing of the flow of the ammonia in the main body 41*a* of the ammonia injection nozzle 41 is achieved also by the absence of a step in the outer peripheral portion of the valve body 161.

The embodiment of the present disclosure has been described above with reference to the attached drawings, but, needless to say, the present disclosure is not limited to the above-mentioned embodiment. It is apparent that those skilled in the art may arrive at various alternations and modifications within the scope of claims, and those examples are construed as naturally falling within the technical scope of the present disclosure.

In the foregoing, an example in which the adjustment structure 6 includes the valve body 61 and the driving device 62 and adjusts the opening area of the injection port 41*b* of the ammonia injection nozzle 41 by moving the valve body 61 in the axial direction with the driving device 62 is described. However, it is only required that the adjustment structure 6 have a function to adjust the opening area of the injection port 41*b* of the ammonia injection nozzle 41, and the adjustment structure 6 is not limited to the above-mentioned example. For example, when the opening area of the injection port 41*b* can be changed by deformation of the distal end portion itself of the main body 41*a* of the ammonia injection nozzle 41, a mechanism including the distal end portion of the main body 41*a* and a driving device that drives the distal end portion may correspond to the adjustment structure 6. In addition, for example, when a member that can move or extend to a radially inner side from the inner peripheral portion of the distal end portion of the main body 41*a* of the ammonia injection nozzle 41 is provided, a mechanism including the member and a driving device that drives the member may correspond to the adjustment structure 6.

In the foregoing, an example in which the pulverized coal injection nozzle 42 is arranged on a radially outer side of the ammonia injection nozzle 41 in the burner 4, and the double cylinder structure is formed by the ammonia injection nozzle 41 and the pulverized coal injection nozzle 42 is described. However, the configuration of the burner 4 is not limited to the above-mentioned example. For example, the pulverized coal injection nozzle 42 may be arranged on a radially inner side of the ammonia injection nozzle 41. In addition, for example, in the burner 4, an air injection nozzle for injecting air for combustion may be added. In this case, for example, the burner 4 may have a triple cylinder structure. Of a space defined by the triple cylinder structure, a space on a center side of the burner 4 may be a flow path for ammonia, a space adjacent to the flow path for ammonia on a radially outer side of the burner 4 may be a flow path for air, and a space adjacent to the flow path for air on the radially outer side may be a flow path for pulverized coal.

In the foregoing, an example in which ammonia and pulverized coal are used as fuel in the furnace 2 is described. However, it is only required that the fuel used in the furnace 2 contain at least ammonia, and the fuel is not limited to the above-mentioned example. For example, the fuel used together with ammonia in the furnace 2 may be fuel (e.g., a natural gas or biomass) other than pulverized coal. In addition, for example, only ammonia may be used as fuel to be used in the furnace 2.

The present disclosure contributes to the decrease in nitrogen oxide (NOx) in a combustion device used in a boiler or the like, and hence can contribute to, for example, Goal 7 "Ensure access to affordable, reliable, sustainable and modern energy for all" and Goal 13 "Take urgent action to combat climate change and its impacts" in Sustainable Development Goals (SDGs).

The invention claimed is:

1. A combustion device, comprising:

a burner including an ammonia injection nozzle having an injection port that faces an inner space of a furnace; and an adjustment structure configured to adjust an opening area of the injection port wherein the burner includes a pulverized coal injection nozzle having an injection port that faces the inner space of the furnace, and wherein the combustion device further comprises a control device configured to control operation of the adjustment structure so that the opening area of the injection port of the ammonia injection nozzle becomes smaller as a flow rate of pulverized coal in the pulverized coal injection nozzle becomes higher.

2. The combustion device according to claim 1, further comprising a control device configured to control operation of the adjustment structure so that the opening area of the injection port of the ammonia injection nozzle becomes smaller as a flow rate of ammonia in the ammonia injection nozzle becomes lower.

3. A boiler comprising the combustion device of claim 1.

4. A combustion device, comprising:

a burner including an ammonia injection nozzle having an injection port that faces an inner space of a furnace;

an adjustment structure configured to adjust an opening area of the injection port:

an air supply portion having an injection port that faces the inner space of the furnace; and a control device configured to control operation of the adjustment structure so that the opening area of the injection port of the ammonia injection nozzle becomes smaller as a flow rate of air in the air supply portion becomes higher.

5. The combustion device according to claim 4, further comprising a control device configured to control operation of the adjustment structure so that the opening area of the injection port of the ammonia injection nozzle becomes smaller as a flow rate of ammonia in the ammonia injection nozzle becomes lower.

6. A boiler comprising the combustion device of claim 4.

7. A combustion device, comprising:

a burner including an ammonia injection nozzle having an injection port that faces an inner space of a furnace;

an adjustment structure configured to adjust an opening area of the injection port; and a control device configured to control operation of the adjustment structure so that the opening area of the injection port of the ammonia injection nozzle becomes smaller as a temperature in the inner space of the furnace becomes higher.

8. The combustion device according to claim 7, further comprising a control device configured to control operation of the adjustment structure so that the opening area of the injection port of the ammonia injection nozzle becomes smaller as a flow rate of ammonia in the ammonia injection nozzle becomes lower.

9. A boiler comprising the combustion device of claim 7.

* * * * *